US005523933A

United States Patent [19]

Swanson

[11] Patent Number: 5,523,933

[45] Date of Patent: Jun. 4, 1996

[54] SHOCK-DAMPENING AND VIBRATION-ISOLATION MOUNT FOR VEHICULAR LIGHTING ASSEMBLY

[75] Inventor: John P. Swanson, Lakewood, N.Y.

[73] Assignee: Betts Industries, Inc., Warren, Pa.

[21] Appl. No.: 314,893

[22] Filed: Sep. 29, 1994

[51] Int. Cl.[6] ..... F21V 15/04

[52] U.S. Cl. ..... 362/390; 362/369; 248/626

[58] Field of Search ..... 248/300, 626, 248/628; 362/288, 369, 390, 61, 80, 457, 458

[56] References Cited

U.S. PATENT DOCUMENTS

| | | | |
|---|---|---|---|
| Re. 30,498 | 1/1981 | Baldwin | 362/296 |
| 1,536,407 | 5/1925 | Pettus | 248/611 |
| 1,786,758 | 12/1930 | Larson | 362/390 |
| 1,948,690 | 2/1934 | Yost | 362/306 |
| 2,503,065 | 4/1950 | Phillips | 362/390 |
| 3,300,636 | 1/1967 | Quelland et al. | 362/369 |
| 3,327,110 | 6/1967 | Baldwin | 362/296 |
| 4,176,391 | 11/1979 | Kulik et al. | 362/390 |
| 4,231,081 | 10/1980 | Borruso | 362/306 |
| 4,282,566 | 8/1981 | Newman | 362/369 |
| 4,740,876 | 4/1988 | Roller | 362/390 |
| 5,169,110 | 12/1992 | Snaith et al. | 248/626 |

FOREIGN PATENT DOCUMENTS

| | | | |
|---|---|---|---|
| 0573277 | 3/1924 | France | 362/390 |
| 0260467 | 6/1913 | Germany | 362/390 |

*Primary Examiner*—Denise L. Gromada
*Assistant Examiner*—Alan B. Cariaso
*Attorney, Agent, or Firm*—Hodgson, Russ, Andrews, Woods & Goodyear

[57] ABSTRACT

A shock-dampening and vibration-isolation mount for a vehicular lighting assembly. The mount comprises a receptacle for a replaceable bulb, a body portion for rigid attachment to the lighting assembly housing, and a pair of arm portions extending between the receptacle and body portion. The arm portions have flexibility for vibration-isolation and have a progressive increase in specific mass along their lengths to provide shock-dampening.

20 Claims, 3 Drawing Sheets

SHOCK-DAMPENING AND VIBRATION-ISOLATION MOUNT FOR VEHICULAR LIGHTING ASSEMBLY

The present invention relates generally to lighting assemblies. More particularly, the present invention relates to the mounts for light bulbs within housings for vehicular lights such as, for example, rear lights on trucks.

The bulbs or lamps for truck lights have been subject to shortened lives due to premature filament breakage as a result of vibration fatigue. Premature filament breakage is also related to the total mass of the bulb and its distribution relative to the mount. Thus, a bulb having greater mass above the mount may tend to "whip" more during downward movement thereby contributing to premature filament breakage.

Patents of interest as showing various shock mounts and the like for vehicular lighting assemblies are U.S. Pat. Nos. Re. 30,498 (a reissue of U.S. Pat. No. 3,327,110); 1,536,407; 1,948,690; 4,176,391; 4,231,081; 4,282,566; and 4,740,876. These patents are incorporated herein by reference to illustrate lamp housings in which the mount of the present invention may be installed.

A truck lighting assembly marketed by Hella, an Austrian company, utilizes an integral plastic shock mount in the form of a receptacle portion for a replaceable bulb and two flexible serpentine-shaped arms extending therefrom and rigidly attached to the housing. The construction of this assembly is such that there is greater bulb mass above the arms which undesirably may cause increased "whipping" during downward bulb movement thereby contributing to premature filament breakage. The serpentine arm pattern of this assembly does not adequately prevent vibration damage resulting undesirably in the bulb having to be replaced frequently. The serpentine pattern also results in a large number of stress points which increases the susceptibility of this mount to breakage.

In order to provide a suitable shock mount for a vehicular lighting assembly, the mount must provide protection against impact shocks (the truck hitting a pot-hole, for example) and against high frequency vibrations which travel through the material of the mount (vibrations due to a tire out of balance, for example). The mount must therefore desirably provide sufficient strength to dampen impact shock and also have sufficient flexibility or resilience to isolate vibrations from the bulb. One may think that an improvement in one of these must aggravate the other. For shock mounts such as the Hella mount described above, an improvement in one does aggravate the other since the mount will either be too flexible to suitably dampen impact shocks or insufficiently flexible to isolate vibrations.

U.S. Pat. No. 4,740,876 to Roller discloses a flexible plastic shock absorbing mount for lamp bulbs for vehicles wherein three flexible arms extend radially outwardly from a central bulb receptacle and continue as a serpentine recurved strip curving about a pair of horizontal axes of curvature along like vertical reverse curved paths for accommodating displacement of the central receptacle in all directions. The flexible arms have end formations to be pivotally connected to pillar formations of the reflector. Roller further states that the flexible arms may be of the same cross-sectional dimensions throughout their length or may be tapered in one or both dimensions along their length.

The pivotal connection of the arms is counter-productive to shock dampening irregardless of the dampening effect which may otherwise be afforded by the arms. Moreover, the pivotal movement results in wear and may cause breakage of the mounting post. The large number of stress points in such a serpentine-shaped structure increases the susceptibility to breakage of the mount.

Roller discloses two kinds of lamp bulbs for its lighting assemblies, one being a flattened base type and another being of the unbased type with the filament leads secured within the receptacle portion by use of a resilient potting material. These bulbs are of light weight not requiring as much strength in the shock mount for impact shock dampening. However, these bulbs are not replaceable thus requiring the expensive replacement of the entire lighting assembly when a bulb burns out.

Replaceable bulbs with heavier bases, for example, brass bases for pressure contact with the leads, desirably require greater shock mount strength for dampening impact shocks. But it is considered desirable that such shock dampening capability not be with the sacrifice of good vibration isolation.

It is accordingly an object of the present invention to provide a vehicle lamp mount which affords long life to the lamp.

It is another object of the present invention to provide such a lamp mount which utilizes a replaceable lamp so that the lamp assembly need not be changed when the lamp requires replacement.

It is a further object of the present invention to provide such a lamp mount that may be mounted to lighting assembly housings in various common ways.

It is yet another object of the present invention to provide such a lamp mount which is self-contained.

It is a still further object of the present invention to prevent or reduce "whipping" of the lamp sideways during its downward movement during impact shock.

It is another object of the present invention to provide such a lamp assembly which is rugged, inexpensive, has a minimum number of parts, and is easy to maintain.

In order that a replaceable bulb may be used in a vehicular lamp assembly so as to have long life, in accordance with the present invention, a shock mount for the vehicular lamp assembly comprises an integral member of flexible material for isolating vibrations and having at least two arms which extend from a receptacle portion to a body portion in a curved path for isolating a bulb filament from vibrations. The body portion is rigidly attachable to the housing, and the specific mass of each of the arms progressively increases along the length thereof so that the arms may provide strength for dampening movements of the bulb due to impact forces.

The above and other objects, features, and advantages of the present invention will be apparent in the following detailed description of the preferred embodiment when taken in conjunction with the accompanying drawings wherein the same reference numerals denote the same or similar parts throughout the several views.

DETAILED DESCRIPTION OF THE PREFERRED EMBODIMENT

Figure 1:
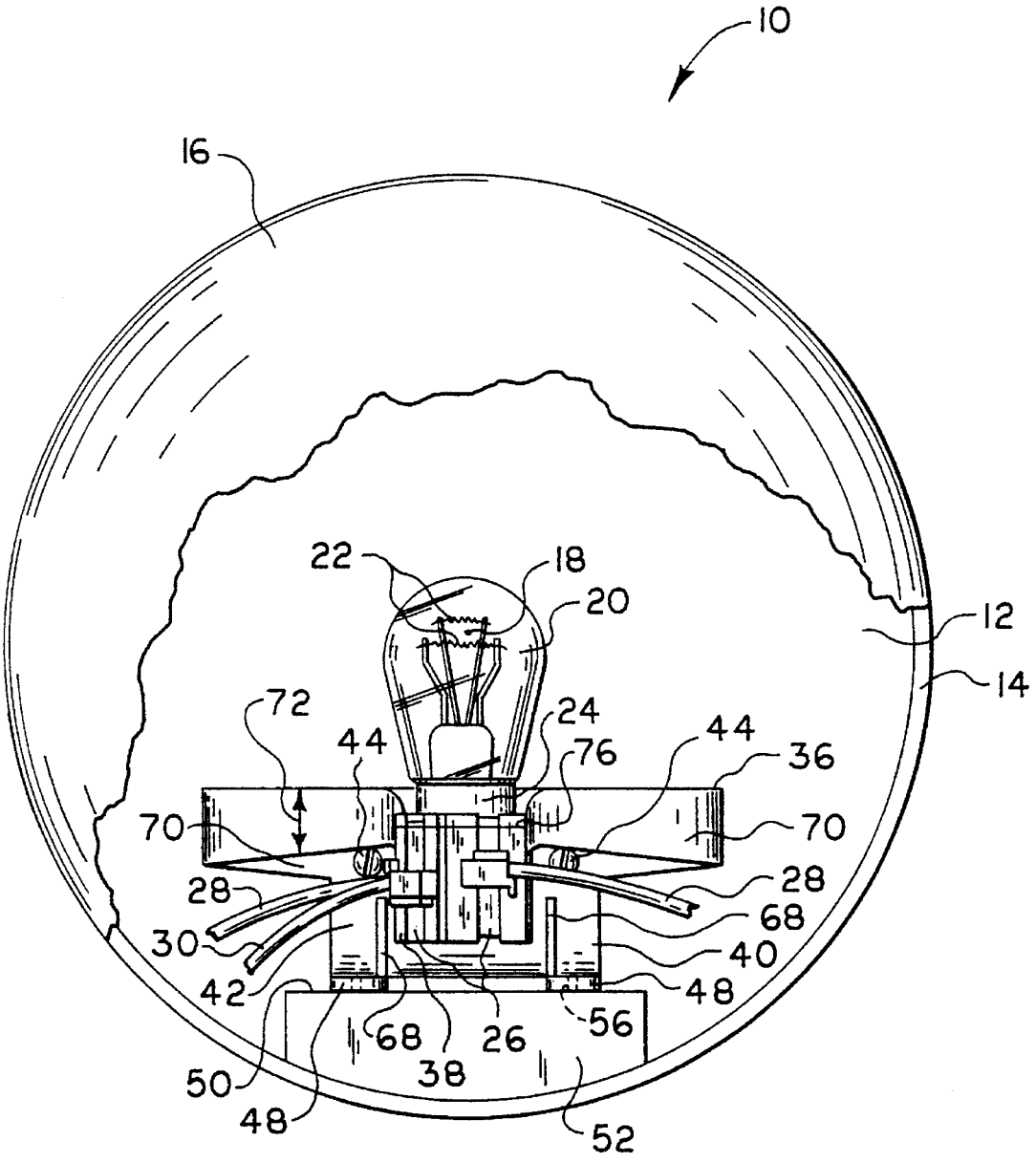
FIG. 1 is a front view, partly schematic, of a lighting assembly, with portions of the lens cover and wires broken away for purposes of clarity, in accordance with the present invention.
Figure 2:
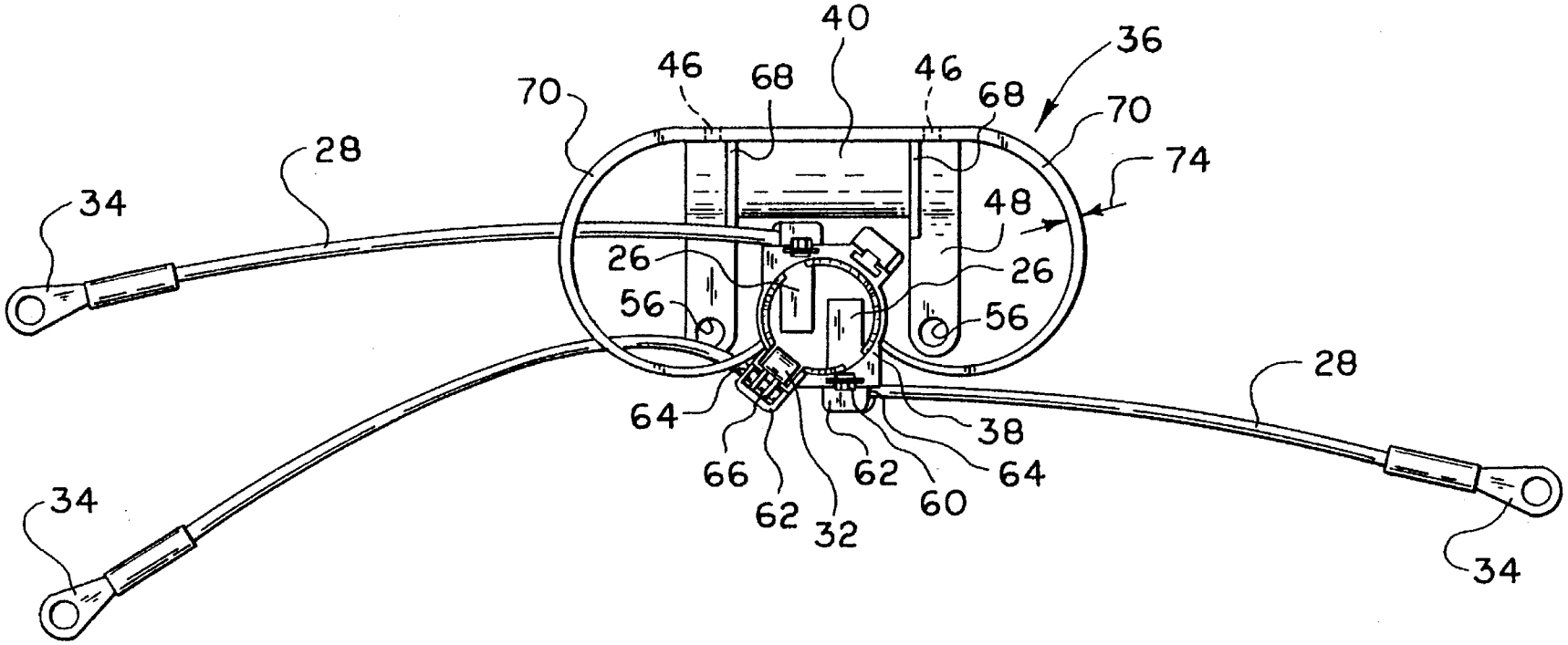
FIG. 2 is a top view of the shock mount therefor.
Figure 3:
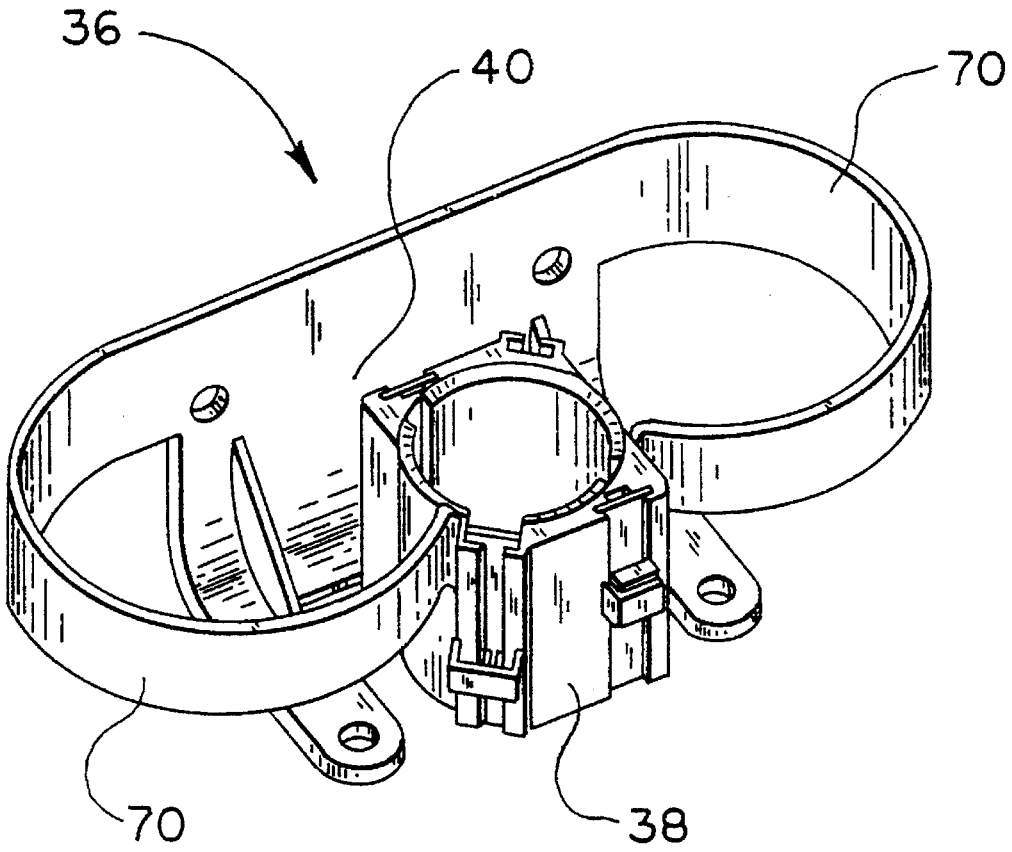
FIG. 3 is a perspective view of the shock mount.

Referring to the drawings, there is shown generally at 10 a lighting assembly for use on a vehicle such as, for example, a rear light on a truck. The lighting assembly 10 includes a main housing 12 which is generally cylindrical with a generally flat surface for added space within the housing and which is suitably attachable to a vehicle. If desired, the housing may be shaped to define a concave surface which is used as a reflector surface. Housing 12 has a flanged rim portion 14 which sealingly receives a lens cover 16. The assembly is intended to have a horizontal optical axis, illustrated at 18, when it is installed on a vehicle for use.

A lamp or bulb for use in the lighting assembly 10 is shown at 20. Although bulb 20 is shown to have two filaments 22, it should be understood that, in accordance with the present invention, the bulb 20 may have one or any other suitable number of filaments. As commonly understood, the bulb 20 should be mounted so that the filaments 22 are generally aligned with the optical axis 18, as seen in FIG. 1, i.e., the filaments 22 are centrally positioned relative to the lens 16. The bulb 20 is desirably of a standard replaceable type allowing easy procurement inexpensively for replacement. The bulb 20 desirably has a brass or other suitable base 24 for pressure contact with terminals 26, which may also be of brass or other suitable material, for electrical wires 28 for the filaments 22 respectively, a ground wire and the terminal therefore being shown at 30 and 32 respectively. The bulb 20 may alternatively be a lighter wedge-base bulb. The wires 28 and 30 have connectors 34 on their ends for connection to the vehicle's electrical system for supplying power to light the bulb 20 in accordance with principles commonly known to those of ordinary skill in the art to which this invention pertains.

The bulb 20 is mounted in the housing 12 by an integral or single piece member 36 composed of plastic or other suitable material and which includes a receptacle portion 38 for receiving the bulb 20 and a body portion 40 for attachment to the housing 12.

In accordance with the present invention, the mount 36 is constructed to provide sufficient damping of movement of the heavy bulb 20 due to shock forces yet also isolate vibrations travelling through the mount material so that the bulb life may not be prematurely shortened.

In order to provide sufficient shock damping capability, the mount 36 is constructed so that the body portion 40 may be rigidly attached to the housing 12. Thus, the body portion 40 has a generally rectangular portion 42 which lies vertically adjacent to the lower portion of the housing 12 and is shown rigidly attached thereto by screws 44 received in mount apertures 46 and in corresponding threaded apertures (not shown) in the housing 12 or by other suitable means. Such an attachment means may be provided for a shallow or flat lens housing. The rectangular portion 42 curves forwardly (toward the lens 16) and ends in a pair of spaced horizontally-extending leg portions 48 which are shown to have apertures, illustrated at 56, for optionally receiving screws (not shown) for rigidly attaching the mount to a generally flat horizontal surface 50 provided by a formation 52 (shown schematically) on the curved lower portion of the housing 12, the screws engaging apertures 56 in the leg portions 48 and corresponding threaded apertures (not shown) in the formations 52 respectively. This allows the same mount to be optionally attached to a deep lens (high hat) housing. A deep lens is one which has a cylindrical portion which projects it outwardly perhaps about 1 ½ inch so as to increase visibility of light from the sides. The bulb must be positioned further to the rear (toward the lens) for the deep lens. Thus, the two sets of apertures 46 and 56 allow the versatility of use of the same mount for either a deep lens or a shallow lens housing. Bracing portions 68 are provided which connect between the vertical portion 42 and the horizontal portion containing the legs 48 of the body portion 40. It should be understood that the body portion may be shaped differently and rigidly attached to the housing in various other ways which are meant to come within the scope of the present invention. It should be appreciated that this allows a wide range of manufacturing flexibility in selecting means for attaching the mount to the housing.

The receptacle 38 is comprised of a generally cylindrical vertical wall for receiving the base 24 of the bulb 20 therein, and vertical slots, illustrated at 60, are provided in the wall for suitably receiving the terminals 26 and 32 in accordance with principles commonly known to those of ordinary skill in the art to which this invention pertains. Formations 62 on the receptacle wall comprise housings in which end portions of wires 28 and 30 respectively are received through apertures, illustrated at 64. The terminals 26 and 32 are then inserted with contacts 66 thereon in the form of fingers which pierce or cut into the wire covering and project into the formation housings to make electrical contact between the wires and the respective terminals as well as to retain the wires in position. The terminals for the filament wires 28 may suitably be loaded from the bottom of the socket 38. The terminal for the ground wire 30 may be loaded from the top of the socket 38 then bent down flush with the side of the socket. A locking tab (not shown) or other suitable means may be provided to retain each terminal to the receptacle. It should of course be understood that, in accordance with the present invention, other suitable means may be employed for mounting the terminals and attaching the wires to them.

A pair of arm portions 70 connect the receptacle portion 38 to the body portion 40. In order to isolate high frequency vibrations (due to an out-of-balance tire and the like), in accordance with the present invention, the arm portions 70 are desirably formed to have a maximum length within the confined space of the housing and the material of which the mount is composed selected to allow flexibility so that the vibrations are ceased before reaching the receptacle. Thus, the arm portions 70 are shown to extend in a generally circular pattern from the body portion 40 to the receptacle portion 38 so as to maximize the length while minimizing the number of stress points. It should of course be understood that more than two arm portions may be provided.

In order to dampen impact shocks as well as isolate vibrations, in accordance with the present invention, in addition to rigidly attaching the mount to the housing, each of the arms portions 70 is shaped to provide a progressive increase in specific mass along its length. A progressive increase in specific mass is provided to achieve a smooth progressivity in strength of the arms as the shock forces increase so that greater dampening is progressively provided as shock forces increase. In accordance with a preferred embodiment of the present invention, the specific mass is increased by progressively increasing the width, illustrated at 72, and/or the thickness, illustrated at 74, of each of the arm portions 70, as seen in the drawings. The mass of the arms 70 is shown to progressively increase from the receptacle 38 toward the body portion 40 thereby associating a minimum additional weight with the receptacle. Thus, the progressive mass increase arm portions 70 may be said to act as a progressive rate spring as in automobile coil springs, i.e., the farther they are bent due to impact shock, the stronger they become to thereby dampen the shock effects.

When the mount is attached to the housing 12, it should be appreciated that, as seen in the drawings, the receptacle portion 38 is forward of the part 42 of body portion 40 to which the arms are attached. As seen in FIG. 1, the arms 70 extend vertically over their width and curve outwardly from the receptacle portion 38 then inwardly and rearwardly to the body portion part 42. This allows flexing of the mount in the horizontal plane to afford the advantage of vibration isolation during the progressive deceleration needed for impact protection of the bulb filament.

It should be noted that during sudden truck decelerations, for example, the bulb 20 may tend to tilt rearwardly as the bulb is moved forwardly and then reverse course to its original position. Further, vertical movements may set in force oscillations forwardly and rearwardly of the bulb 20. Further in accordance with the present invention, in order to reduce whipping of the bulb back and forth or sideways during such movement, the arms 70 are positioned relative to the receptacle 38 so that the center of attachment of the arms 70 to the receptacle 38 is substantially in line with the bulb center of gravity, i.e., the bulb and receptacle mass above a line, illustrated at 76, joining the mid-points of the lines of attachment of the arms to the receptacle, is substantially equal to the bulb and receptacle mass below the line 76. The receptacle mass includes the terminals and a portion (which may be negligible) of the wire weight. This line 76 is referred to herein and in the claims as the "center of attachment" of the arm portions 70 to the receptacle portion 38. Thus, in order to achieve such a balanced bulb position wherein the bulb is supported substantially at the center of gravity, the arms 70 are shown to extend above the top edge of the receptacle 38. The positioning of the receptacle so that the center of attachment is at the bulb center of gravity reduces the distance the bottom of the bulb travels sideways during impact shock. The distance the top of the bulb (containing the filaments) moves is also reduced for the same period of time. Thus, the top of the bulb travels at a slower speed and has less momentum (by perhaps as much as 40 percent). Therefore, the filaments are distorted less when the bulb begins to swing back translating into longer life. However, it may be desirable that the bulb center of gravity be slightly below the center of attachment to provide bulb stability, i.e., so that the initiation of random bulb movements under slight shocks may be retarded.

The arms 70 are preferably pre-shaped by means of offsetting circles for the thickness difference so that machine tooling may be used rather than CNC.

The plastic or other material of which the mount 36 is composed is selected to provide in conjunction with its size the desired quality of flexibility, adequate handling of the heat which is generated, as well as inexpensiveness. The following example of a suitable mount material and size is given for purposes of illustration and not for purposes of limitation. The mount plastic material may, for example, be 6/6 nylon which may have glass or mineral filler for greater heat resistance. The width 72 of the arms 70 may progressively increase from perhaps about 0.29 inch at the receptacle 38 to perhaps about 0.49 inch at the body portion 40. The thickness 74 of the arms 70 may progressively increase from perhaps about 0.044 inch at the receptacle 38 to perhaps about 0.084 inch at the body portion 40. The length of each of the arms 70 may perhaps be about 2.6 inches. Such arms may suitably be used with a brass base replaceable bulb weighing perhaps about 10 grams to effectively isolate vibrations and dampen impact shock for an increased bulb life. Further, only the bulb, which may be standard and readily available, need be replaced when it finally burns out.

It should be understood that, while the invention has been described in detail herein, the invention can be embodied otherwise without departing from the principles thereof, and such other embodiments are meant to come within the scope of the present invention as defined by the appended claims.

What is claimed is:

1. A mount for a bulb of a vehicle lighting assembly including a housing, the mount comprising a member including a receptacle portion adapted for receiving a bulb, a body portion, means for rigidly attaching said body portion to the housing, and means comprising at least two elongate flexible arm portions which extend in a path between said receptacle portion and said body portion for isolating a filament of the bulb from vibrations, said arm portions including means for dampening movements of the bulb due to impact forces, wherein said receptacle portion is forward of a part of said body portion to which said arm portions are attached, said arm portions curving outwardly from said receptacle portion then inwardly and rearwardly to said body portion.

2. A mount according to claim 1 wherein said receptacle portion includes means for receiving a replaceable bulb.

3. A mount according to claim 1 wherein said arm portions are attached to said receptacle portion so that the center of attachment of said arm portions is substantially in line with the center of gravity of the bulb.

4. A mount according to claim 1 wherein the mount is a single piece of a plastic material.

5. A mount for a bulb of a vehicle lighting assembly including a housing, the mount comprising a member including a receptacle portion adapted for receiving a bulb, a body portion, means for rigidly attaching said body portion to the housing, and means comprising at least two elongate flexible arm portions which extend in a path between said receptacle portion and said body portion for isolating a filament of the bulb from vibrations, said arm portions including means for dampening movements of the bulb due to impact forces, wherein said dampening means comprises said arm portions characterized by a progressive increase in specific mass of each of said arm portions along the length thereof.

6. A mount according to claim 5 wherein said member is composed of a plastic material.

7. A mount according to claim 5 wherein said arm portions extend in a curved path to provide increased arm portion length with a minimum of stress points.

8. A mount for a bulb of a vehicle lighting assembly including a housing, the mount comprising a member including a receptacle portion adapted for receiving a bulb, a body portion, means rigidly attaching said body portion to the housing, and means comprising at least two elongate flexible arm portions which extend in a path between said receptacle portion and said body portion for isolating a filament of the bulb from vibrations, said arm portions including means for dampening movements of the bulb due to impact forces, wherein said dampening means comprises said arm portions characterized by a progressive increase in at least one of thickness and width of each of said arm portions along the length thereof.

9. A mount for a bulb of a vehicle lighting assembly including a housing, the mount comprising a member including a receptacle portion adapted for receiving a bulb, a body portion, means for rigidly attaching said body portion to the housing, said means comprising at least two elongate flexible arm portions which extend in a path between said receptacle portion and said body portion for isolating a filament of the bulb from vibrations, said arm portions including means for dampening movements of the bulb due to impact forces, wherein said dampening means comprises said arm portions characterized by a progressive increase in specific mass of each of said arm portions along the length thereof from said receptacle portion to said body portion.

10. A mount for a bulb of a vehicle lighting assembly including a housing, the mount comprising a member including a receptacle portion adapted for receiving a replaceable bulb, a body portion, means for rigidly attaching said body portion to the housing, means comprising at least two elongate flexible arm portions which extend in a curved path between said receptacle portion and said body portion for isolating a filament of the bulb from vibrations, and means comprising said arm portions characterized by a progressive increase in specific mass of each of said arm portions along the length thereof for dampening movements of the bulb due to impact forces.

11. A mount according to claim 10 wherein said arm portions are attached to said receptacle portion so that the center of attachment of said arm portions is substantially in line with the center of gravity of the bulb.

12. A mount according to claim 10 wherein said arm portions are characterized by a progressive increase in at least one of thickness and width of each of said arm portions along the length thereof.

13. A mount according to claim 10 wherein said receptacle portion is forward of a part of said body portion to which said am portions are attached, said arm portions curving outwardly from said receptacle portion then inwardly and rearwardly to said body portion.

14. A vehicle lighting assembly comprising a housing, a lens cover for the housing, and a bulb mount including a receptacle portion adapted for receiving a bulb, a body portion rigidly attached to said housing, and means comprising at least two elongate flexible arm portions which extend in a path between said receptacle portion and said body portion for isolating a filament of the bulb from vibrations, said arm portions including means for dampening movements of the bulb due to impact forces, wherein said dampening means comprises said arm portions characterized by a progressive increase in specific mass of each of said arm portions along the length thereof.

15. A lighting assembly according to claim 14 further comprising a replaceable bulb received in said receptacle portion.

16. A lighting assembly according to claim 15 wherein said arm portions are attached to said receptacle portion so that the center of attachment of said arm portions is substantially in line with the center of gravity of said bulb.

17. A lighting assembly according to claim 14 wherein said arm portions extend in a curved path to provide increased arm portion length with a minimum of stress points.

18. A lighting assembly according to claim 14 wherein said mount is a single piece of a plastic material.

19. A vehicle lighting assembly comprising a housing, a lens cover for the housing, and a bulb mount including a receptacle portion adapted for receiving a bulb, a body portion rigidly attached to said housing, and means comprising at least two elongate flexible arm portions which extend in a path between said receptacle portion and said body portion for isolating a filament of the bulb from vibrations, said arm portions including means for dampening movements of the bulb due to impact forces, wherein said receptacle portion is forward of a part of said body portion to which said arm portions are attached, said arm portions curving outwardly from said receptacle portion then inwardly and rearwardly to said body portion.

20. A lighting assembly according to claim 19 wherein said receptacle portion includes means for receiving a replaceable bulb.

* * * * *